United States Patent [19]

Newman

[11] 4,227,305

[45] Oct. 14, 1980

[54] HAND TOOL FOR CUTTING BLIND STRIPS AND THE LIKE

[76] Inventor: Jerry C. Newman, 5410 W. 134th St., Hawthorne, Calif. 90250

[21] Appl. No.: 19,867

[22] Filed: Mar. 12, 1979

[51] Int. Cl.[3] ..... B26B 13/10

[52] U.S. Cl. ..... 30/229; 30/233

[58] Field of Search ..... 30/179, 229, 233, 293, 30/231, 230; 83/581, 580

[56] References Cited

U.S. PATENT DOCUMENTS

| | | | |
|---|---|---|---|
| 1,082,385 | 12/1913 | Zimmerman | 30/233 |
| 1,675,563 | 7/1928 | Klohe | 83/581 |
| 3,393,595 | 7/1968 | Halverson | 83/580 |

FOREIGN PATENT DOCUMENTS

| | | | |
|---|---|---|---|
| 644696 | 1/1964 | Belgium | 83/581 |

*Primary Examiner*—Jimmy C. Peters

*Attorney, Agent, or Firm*—Herzig & Walsh, Incorporated

[57] ABSTRACT

Manually operated tool, primarily a hand tool, for cutting strip elements, more especially, blind strips of Venetian blinds. The tool has cooperating blades. Associated with one of the blades is a feed guide particularly configurated to be adapted to the shape of the strip to be cut for accurate delivery to the blades. Associated with the blades also is a measuring gauge for accurately measuring the amount to be cut off. The blades are especially configurated to be adapted to cut strip material having transverse curvature and further to make a curved cut providing a finished end to the strip being cut.

11 Claims, 7 Drawing Figures

HAND TOOL FOR CUTTING BLIND STRIPS AND THE LIKE

BACKGROUND OF THE INVENTION

1. Field of the Invention

The field of the invention is that of manually operable tools for cutting off and finishing lengths of strip material, the tool being designed to be primarily adaptable for cutting Venetian blind strips, mini-blinds, levelers, louvers, etc.

2. Description of the Prior Art

Prior art patents known to the herein inventor are U.S. Pat. Nos. 856,403; 1,082,385, 1,251,101; 1,263,492; 3,393,595; and 3,840,989.

The nature of the prior art is best illustrated with reference to the problem of installation of blinds, that is, Venetian blinds, at sight. Frequently, installers on the job find that blinds, that is, the blind elements or slats, when received are oversized resulting from the window measure of the blind manufacturing process having been done incorrectly. This typically results in the need to return the blinds to the manufacturer for rework, the proper dimensioning and properly finishing of the ends.

The prior art is lacking in an implement or tool having the capability of individually cutting a blind blade or slat individually to a desired length while providing the blind blade or slat with a finished edge and perfect condition for window installation.

Thus, a particular and definite need is present in the art for a tool or implement calable of meeting requirements as identified in the foregoing.

SUMMARY OF THE INVENTION

In a preferred form of the invention as described in detail herein, it is adapted for accurately cutting off and finishing blind blades, slats or strips at the site, providing for window installation.

In the preferred form as described in detail herein, it is a manually operated scissors type tool having members that are pivoted together, each member carrying a blade adapted for the particular service intended. One blade carries a feed guide member having a configuration, and of a contour whereby to be adapted to receive elements, that is, blind strips having a curved configuration, that is, a lateral or transverse curvature. Typically, such blind strips or slats in the finished condition have a rounded or curved contour at the ends with beveled corners. The blades of the tool are particularly constructed and conformed whereby to provide for a cut so that, when the cut is made, the end of the blind strip or slat is in a finished condition, properly rounded or contoured with the corners beveled so that it is adapted for immediate professional installation at the site.

The tool preferably is constructed of tempered steel, carbide steel and/or iron. Hard durable plastic may be used with the exception of the replaceable steel blades.

The steel blades are die cut and are replaceable, the blades providing the finished edges on the blind strips or slats.

In addition to the feed guide member, the tool is provided with a reduction measuring slide gauge with a slide adjustment bar and slat stop arm to insure precision and exactness.

In light of the foregoing, the object of the invention is to fill the need set forth in the foregoing for a tool or implement capable of on-site cutting and finishing of particular elements, and more especially, Venetian blind strips or slats making them ready for immediate installation.

A further object is to realize a tool adapted to meet the foregoing need which is a manually operated tool of scissors type provided with a feed guide strip configurated to be adapted to receive and guide blind strips or slats and provided with cooperating cutting blades shaped to have the capability of cutting off the blind blades or slats, leaving them in a finished condition for installation.

Further objects and advantages of the invention will become apparent from the following detailed description.

BRIEF DESCRIPTION OF THE DRAWINGS

FIG. 1 is an isometric view of the preferred form of the invention;

Figure 1A:
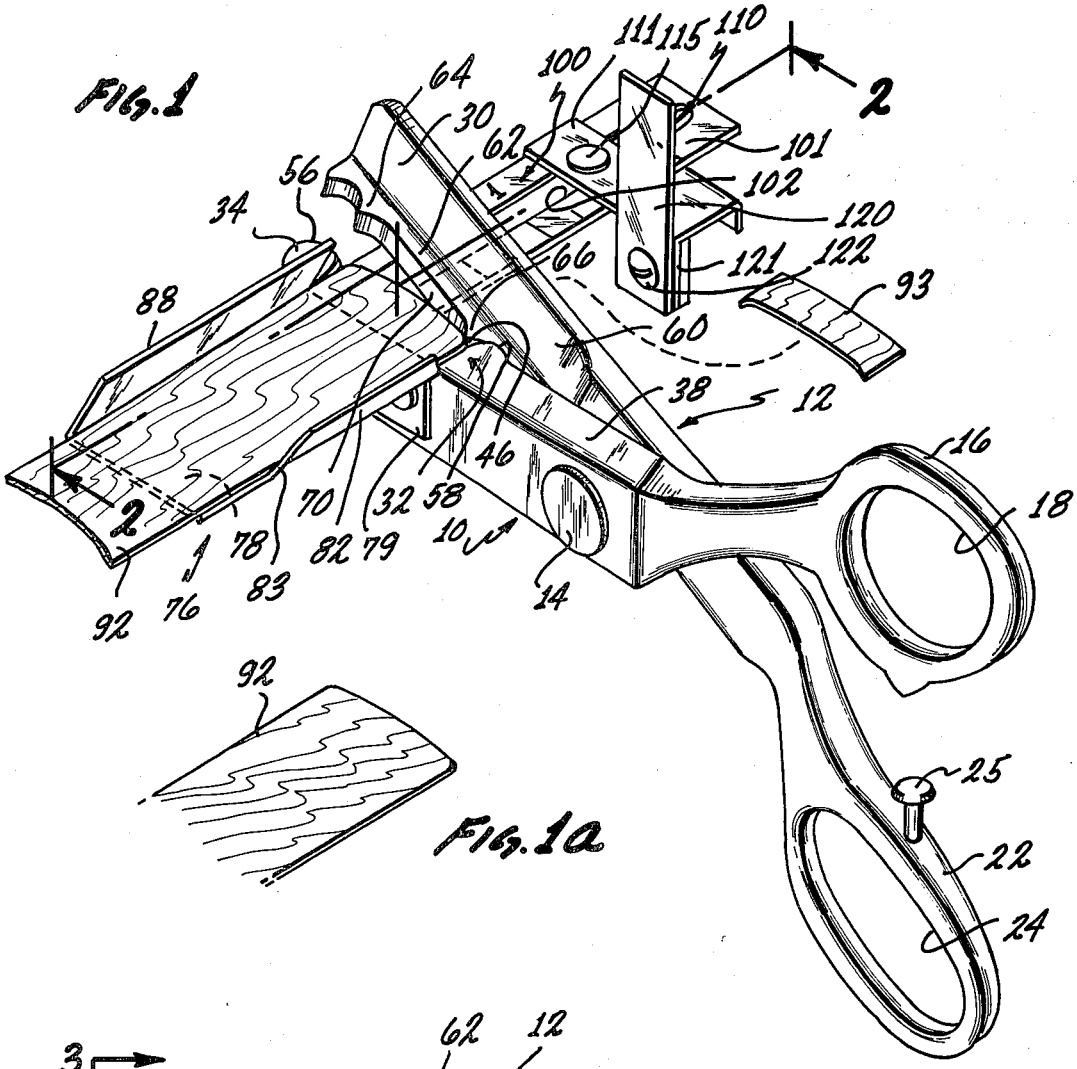
FIG. 1*a* is a detail view of the end part of a blind strip to be cut off.
Figure 2:
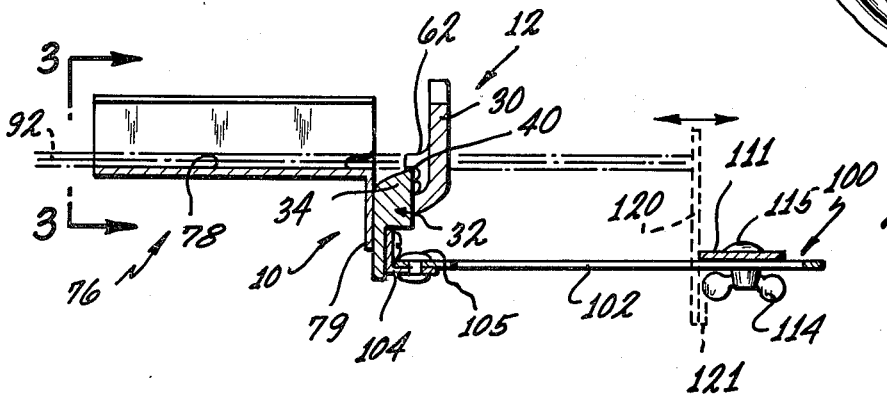
FIG. 2 is a sectional view taken along the line 2—2 of FIG. 1.

DESCRIPTION OF THE PREFERRED EMBODIMENT AND BEST MODE OF PRACTICING THE INVENTION

Referring now more particularly to the drawings, there is shown a tool resembling a scissors which includes lever members 10 and 12 which are pivotally attached together for relative pivoting movement by way of pivot means 14. The lever member 10 has a handle part 16 with an opening 18, and the lever member 12 has a handle part 22 with an opening 24 through it. The member 25 designates a screw carried by the handle part 22 which limits movement of the handles towards each other.

Figure 3:
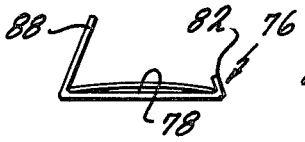
FIG. 3 is a view taken along the line 3—3 of FIG. 2.

At the extremities of the lever members 10 and 12, cutting blade members are carried for mutual cooperation. The end part of the blade 12 is designated by the numeral 30, and the end part of the blade 10 is designated by the numeral 32. See FIG. 3. The end part 32 of the lever member 10 carries a blade 34 which is in the form of an anvil. It may be formed integrally at the end of the blade 10, or it may be formed as a separate element secured to the blade 10. In the form of the invention shown, at the top of the lever 10, there is a beveled flange as designated at 38.

Figure 4:
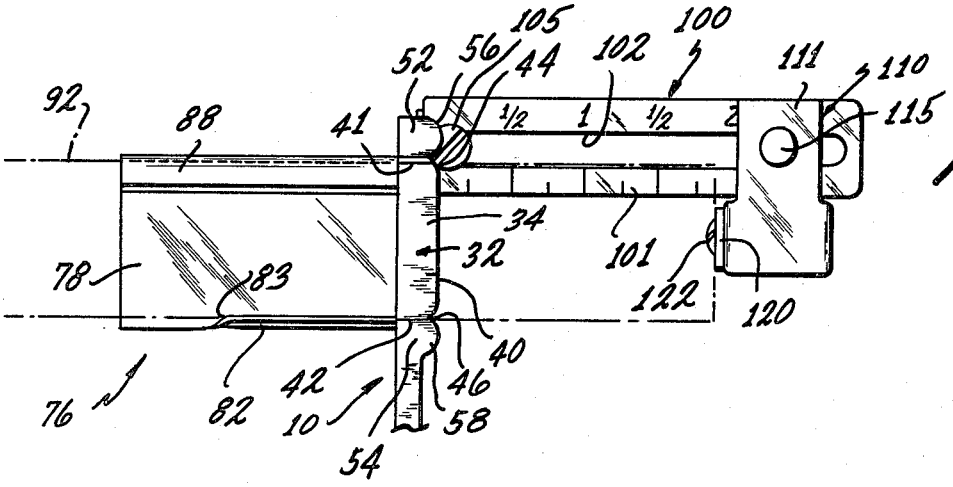
FIG. 4 is a plan view of the tool showing the bottom blade only.
Figure 5:
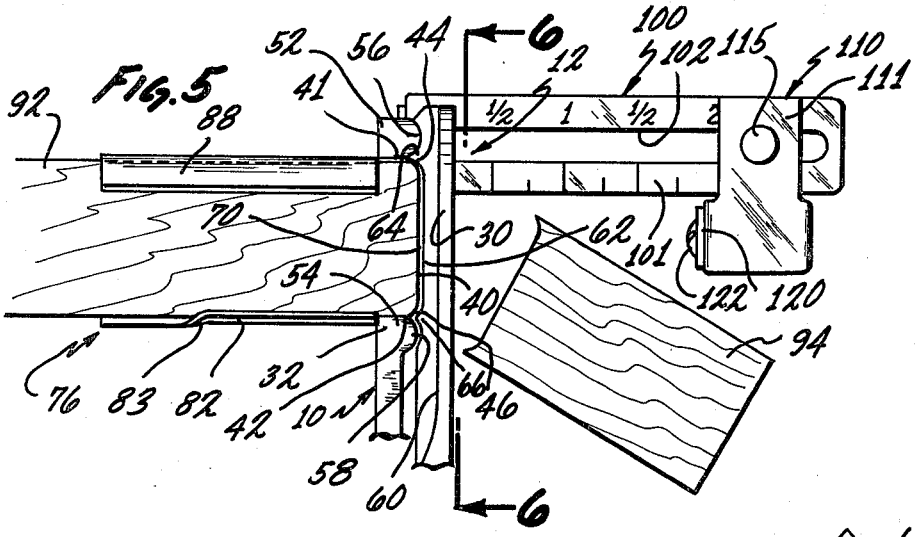
FIG. 5 is a view similar to that of FIG. 4, showing the second blade in cutting position.

The blade or anvil 34 has a shape or configuration as may be seen. The blade 34, as shown in FIGS. 4 and 5, has a corner edge, as designated at 40. The ends of the cutting part of the blade are designated at 41 and 42, the blade having rounded or beveled corners, as designated at 44 and 46. Preferably, the top surface of the blade has a slight upward slant from left to right in the view of FIGS. 4 and 5. At the ends of the blade 34 beyond the extremities 41 and 42 are extending parts 52 and 54 which have rounded faces on their right-hand sides, as designated at 56 and 58, which cooperate with the other blade, as will be described.

The end of the lever member 12 has a flat surface 60, as shown in FIG. 5, and at the lower end of this part is formed a cutting blade 62. This blade has pointed projections or extensions, as designated at 64 and 66, which conform to, and are complementary with the indentations in the blade 34, which are between the intermediate part of the blade and the end parts 52 and 54, these parts mutually cooperating so as to guide the blades in their cooperative action. Between the extensions 64 and 66 on the blade 62, the surface is contoured, as designated at 70, so that when a blind slat or strip is cut off, it is cut off with a shape and contour to provide a finished element with the end appropriately contoured with the corners beveled.

A feed guide member is provided for purposes of accurately guiding the strip to be cut through the tool and to cutting position. This member is designated by numeral 76. It has a flat bottom 78 having a right angle portion 79 which is attached to the end part of the blade 10 by screws or the like. At one side of this member is a lip or flange 82, an end part of which is designated at 83. On the other side of the member 76 is an inwardly bent flange 88. Numeral 92 designates a typical Venetian blind strip inserted into the guide 76, and numeral 93 designates an end part of it which has been cut off, numeral 94 in FIG. 5 designated another end part that has been cut off, these parts serving to illustrate the finished contouring at the end of the strip.

The tool includes a gauge member of scale for accurately measuring or fixing the amount of the strip to be cut off. The gauge or scale is designated by the numeral 100, it being a strip of material having a scale along one edge, as designated at 101, and having an intermediate or medial slot opening. At the inner end of the scale, it is secured to an angle bracket 104 by a bolt 105, the bracket being secured to the end part 32 of the blade 10 by screws, as shown.

Carried by the gauge or scale 100 is a slider 110 which includes a flat member 111 having a downwardly extending flange at one end and which carries a wing nut 114 which is on a screw 115 and passes through the slot 102 so that the slider 110 can be set in any desired position with the part 111 adjacent an indication or graduation on the scale 101. Attached to the part 111 is an upstanding abutment member 120 which is attached to a flange 121 on the part 111 by a bolt 122.

Figure 6:
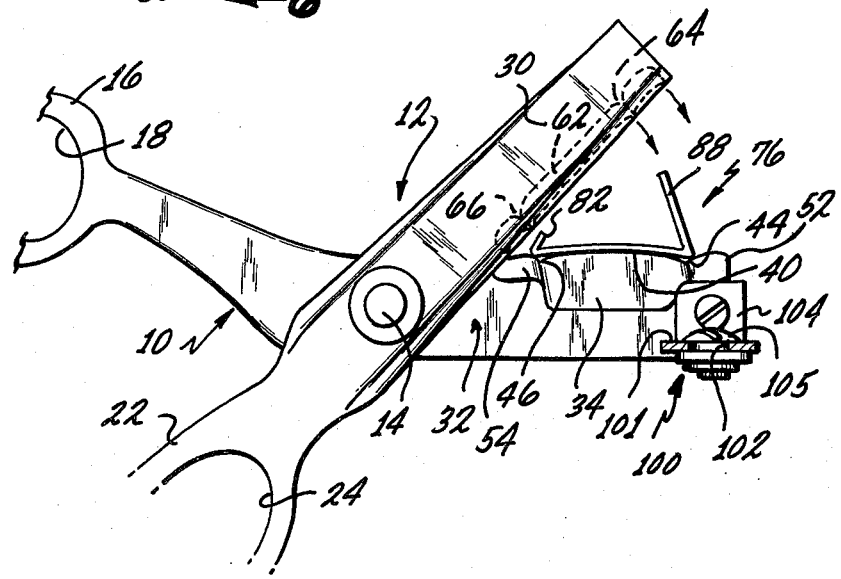
FIG. 6 is a view taken along the line 6—6 of FIG. 5.

From the foregoing, those skilled in the art will readily understand the construction of the tool and the manner of its utilization. The slider 110 is first set with respect to a graduation on the scale 101 to determine the amount that has to be cut off a strip or slat to be cut. The stop member 120 is aligned with a graduation on the scale, as shown in FIG. 4. The strip to be cut is then inserted into the guide 76 and is accurately guided by the side flanges and is passed between the blades of the tool and then against the stop member 120. When the handles are operated for cutting, the upper blade 62 comes down and cooperates with the lower blade or anvil 34 to make an accurate contoured cut at the end of the strip so that the result is that the strip has a finished end not requiring further operations. The relative movement of the blades is guided by the projections 64 and 66 on the upper blade cooperating with the corresponding indentations on the lower blade or anvil between its intermediate part and end parts 52 and 54. Because of the contouring of the lower blade or anvil and the upper blade, the contour of the cut is as desired. Typically, the blind blades or strips are curved or arcuate in shape, as may be seen in FIG. 6. The flanges 82 and 88 at the sides of the feed guide 76 accurately position the blade or strip so that the contoured cut is made as desired.

From the foregoing, those skilled in the art will readily understand the nature of the invention, its construction, its utilization and the manner in which it achieves and realizes the objectives as set forth in the foregoing. In the form of the invention as disclosed, it is primarily adapted for cutting off blind strips so as to provide a finished end at the cut end of the strip. It is to be realized, however, that the invention can be readily utilized and adapted for cutting off accurately other types of material or strips of material.

The foregoing disclosure is representative of a preferred form of the invention and is to be interpreted in an illustrative rather than a limiting sense, the invention to be accorded the full scope of the claims appended hereto.

What is claimed is:

1. A tool for cutting blind strips and the like including relatively reciprocatable members, each one of which carries a cutting blade, and means for guiding a strip to be cut to a cutting position, said blade having contoured portions along their length whereby to provide a cut having a corresponding contour at the cut edge of the strip, and guide means to guide said strip accurately to said contoured portions.

2. A tool as in claim 1 wherein the said blades are additionally contoured whereby to provide a contour at the cut edge of the strip having beveled corners.

3. A tool as in claim 1 wherein one of the blades forms an anvil portion carried by one of the members and with which the other blade cooperates, the said anvil having an upward slant toward the cutting edge of the blade.

4. A tool as in claim 1 wherein the blades have cooperating cutting edges which cooperate with a slicing action when the reciprocatable members are manipulated.

5. A tool as in claim 1 wherein one of the blades forms an anvil having transverse curvature to accommodate strips to be cut having corresponding curvature.

6. A tool for cutting blind strips and the like including relatively reciprocatable members, each of one which carries a cutting blade, and a means for guiding a strip to be cut to a cutting position, said blades being mutually contoured whereby to provide a cut having a corresponding contour at the cut edge of the strip, the said blades being additionally contoured whereby to provide a contour at the cut edge of the strip having beveled corners, the cutting blades having mutually engageable cutting surfaces positioned at the extremities of the cutting blades.

7. A tool as in claim 6 wherein the mutually engageable guiding surfaces include extending projections on one of the blades and complementary configurated recesses on the other of the blades with which the projections cooperate.

8. A tool as in claim 7 including a feed guide carried by one of the members positioned to guide a strip to be cut into a position between the blades, the feed guide having side flanges to guide the strip.

9. A tool as in claim 8 including a measuring gauge carried by one of the members having a scale and an adjustable stop member whereby a strip to cut may be accurately positioned for cutting off a measured amount.

10. A tool as in claim 1 adapted for cutting strips having a transverse curvature, one of the said blades being contoured to accomodate said curvature, the said blades being complementarily contoured to provide a finished contoured cut across the end of the blade, including bevelled corners, the said guiding surfaces being beyond the cutting portions of the blade and serving to guide the relative movement of the blades.

11. A tool as in claim 10 wherein one of the blades has extending projections and the other of the blades has complementary configurated recesses to receive the projections on the other blade.

* * * * *